United States Patent [19]

Wiklund

[11] Patent Number: 4,523,630

[45] Date of Patent: Jun. 18, 1985

[54] ROOM VENTILATOR

[75] Inventor: Klas R. Wiklund, Täby, Sweden

[73] Assignee: Wirab System A.B., Täby, Sweden

[21] Appl. No.: 586,817

[22] Filed: Mar. 6, 1984

[30] Foreign Application Priority Data

Mar. 16, 1983 [SE] Sweden ..... 8301447

[51] Int. Cl.[3] ..... F24D 11/00

[52] U.S. Cl. ..... 165/18; 165/54; 98/33.1

[58] Field of Search ..... 165/4.10, 18, 54; 98/33 R; 236/15 BE; 416/193 R; 415/77

[56] References Cited

U.S. PATENT DOCUMENTS 2,367,359 1/1945 Krogh et al. .
3,143,283 8/1964 Downs ..... 415/77

FOREIGN PATENT DOCUMENTS 0030863 6/1981 European Pat. Off. .
2481423 10/1981 France ..... 165/54
173963 1/1961 Sweden .
386254 8/1976 Sweden .
821853 4/1981 U.S.S.R. .

*Primary Examiner*—William E. Wayner
*Assistant Examiner*—John Sollecito
*Attorney, Agent, or Firm*—Larson and Taylor

[57] ABSTRACT

A ventilator intended for placing in an outer wall has a double-acting axial-flow fan with an inner and an outer impeller blade ring disposed such that the blade rings are each in register with a coaxial channel in a duct placed in a through-opening in the wall. A reversing means is connected to the impeller motor for changing the direction of rotation thereof so that it alternatingly rotates in one or the other direction. A regenerator means is inserted in the channels, the means both absorbing heat and distributing moisture within itself.

10 Claims, 2 Drawing Figures

ROOM VENTILATOR

Figure 1:
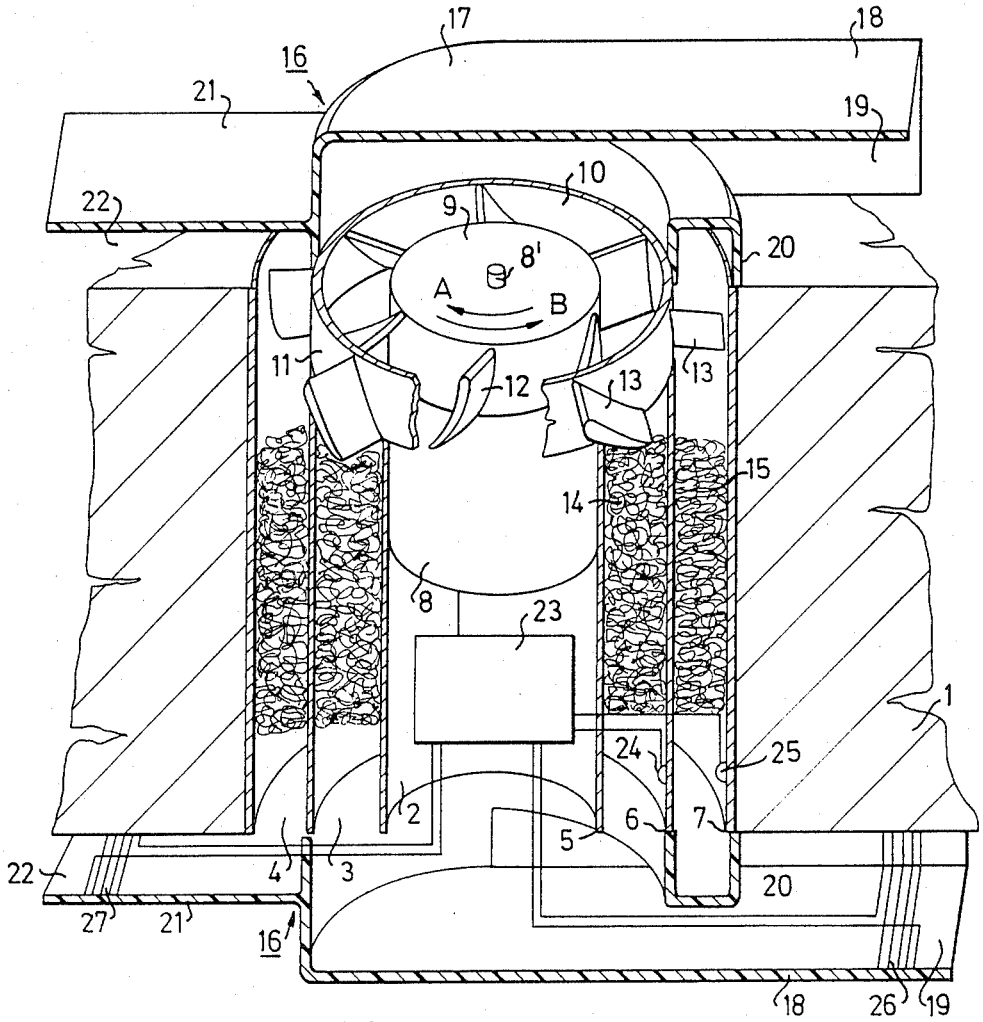

The present invention relates to a ventilator intended for placing in a wall for providing air exchange through the wall.

In the ventilation of buildings, e.g. for reducing the indoors radon content, or for quite simply airing out stale air and replacing it with fresh air with the aid of a central fan system, a large part of the capital costs is inherent in ducts and leads-through to the centrally placed ventilation and heat supply unit.

It is already known, however, that ventilation of an individual room unit can take place with the aid of a ventilator placed in an outer wall, which eliminates the need of ducts and the insulation thereof, which must be provided for the temperature of the ventilation air not being changed to an essential extent during the transport of the ventilation air, but this type of ventilator has previously not had a satisfactory function.

An example of such a ventilator is described in the Swedish patent specification 173 963. This ventilator has a double-acting axial-flow fan with an outer and an inner impeller ring placed in conjunction with two coaxial channels. The inner series of impeller blades are placed such as to supply the inner channel with the blades turned so that air is sucked out from the ventilated room when the fan is rotated. The outer series of impeller blades is placed at the outer channel with the blades turned so that air is sucked in from the outside to the ventilated room when the fan is rotated. A duct provided with parallel guide channels placed in a ring is connected to the axial channels and is of a configuration such that alternate channels lead inlet air and the others lead outlet air. The duct is provided with an annular recuperator having good heat conductivity, through which both inlet air and outlet air are taken, although with separate through passages determined by the channel-equipped duct. The intention with the recuperator is that the heat transfer shall take place between the outlet and inlet air due to heat conductivity in the recuperator, so that the inlet air is heated up before entry into the room, if it is cold outside. A disadvantage with this ventilator is that the duct with the recuperator utilized as a heat exchanger utilizes different sections for the inlet air and for the outlet air. This makes it inefficient. Another disadvantage with this is that condensate is precipitated due to the fact that the warm outwardly flowing outlet air having a high moisture content during the cold season is cooled down by the cold inflowing inlet air. The condensate must be lead off somewhere, and the room air will be very dry since the cold inflowing air has a low moisture content and no moistening of the inlet air takes place.

It is essential that a ventilator gives as comfortable an environment as possible in the ventilated space. It is essential that the moisture in the air indoors is kept at a relatively high level, i.e. at a relative humidity preferably exceeding 40%. The room must not be felt as being drafty either, which in turn means that the inflowing air must have a temperature which is as near as possible in agreement with the room temperature.

Accordingly, it is the primary object of this invention to provide a ventilator to be placed in an outer wall in a building and yet provide a well-temperated, humidified ventilation air.

By utilizing a fan having an impeller with an inner and an outer impeller ring with the respective series of blades set so that, when the fan is rotated, air is carried in different directions through both impeller rings of the fan, and with the aid of these, via an outer and inner channel in a coaxial duct and by allowing a reversing means to change the direction of rotation of the fan so that it alternatingly feeds inlet air through the inner channel and outlet air through the outer channel and then inlet air through the outer channel and outlet air through the inner channel, there being furthermore a regenerator inserted in either channel such as to absorb and distribute both moisture and heat, there is obtained a ventilator which provides heating of the inflowing air with the heat which has been stored in the regenerator in the respective channel during the previous half period with outflowing air through the channel, as well as moisturizing the air with the moisture which was precipitated during this previous half period.

In the ventilation of buildings, it is often attempted to keep a given subpressure indoors in relation to the atmospheric pressure outdoors. This can be provided extremely well with the ventilator in accordance with the invention if the impeller blades in both outer and inner series are conventionally streamlined and set such that in both impeller blade rings they give the greatest air transport action in sucking out the interior air, i.e. they have the smoothly rounded part of the blade facing away from the room to be ventilated.

In order that the outlet air and the inlet air will not be mixed, the ventilator is preferably provided with a means on both sides of the wall in which it is located, this means ensuring that the inlet air is taken from an area at a distance from the area where air is blown out.

Figure 2:
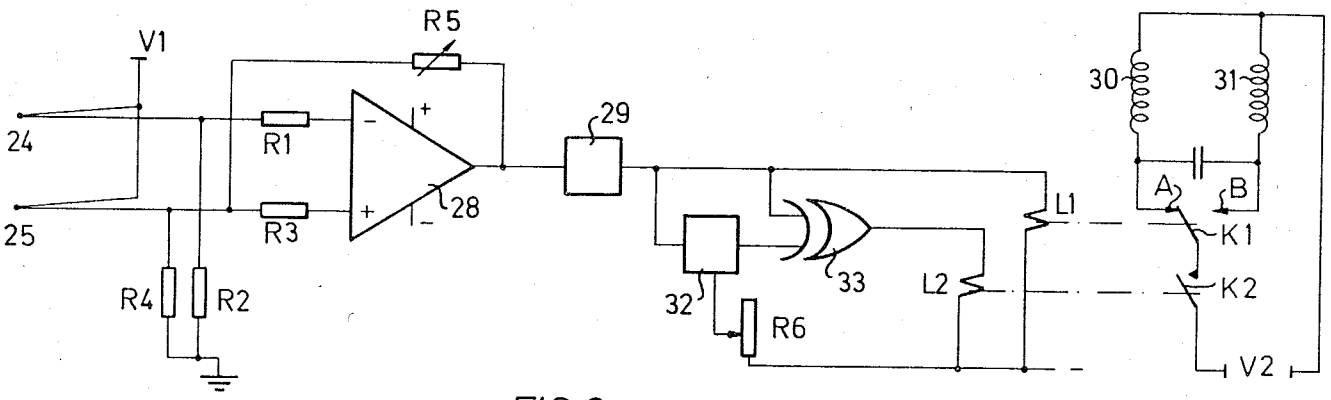

The invention will not be described in detail below with reference to the accompanying drawings, on which FIG. 1 is a perspective view, partially in section, of an embodiment of the inventive ventilator, and FIG. 2 illustrates an embodiment of a regulator circuit for the ventilator in accordance with the invention.

An embodiment of the ventilator in accordance with the invention is illustrated in FIG. 1, inserted in an outer wall 1. A cylindrical duct is inserted in a through-hole in the wall and has a cylindrical central section 2 and two channels 3 and 4 coaxial therewith are formed by three cylinders 5, 6, 7 having different diameters and located mutually coaxially. The inner diameter of the inmost cylinder 5 is suited to the outer diameter of a motor 8 having a reversible direction of rotation, this motor being accommodated in the cylinder 5 with its drive shaft 8' facing towards the outside of the wall. An axial-flow impeller unit 9 with two coaxial series of impeller blades forming impeller rings 10 and 11 is mounted on the drive shaft 8'. The radial width of the inner blade ring 10 is adjusted to the radial width of the space 3 between the cylinders 5 and 6, and the radial width of the outmost blade ring 11 is adjusted to the radial width of the intermediate space 4 between the cylinders 6 and 7. The cross-sectional areas of the spaces 3 and 4 are preferably selected such as to be substantially equally as great so that equally great volumes of air can be fed through both the channels formed by these spaces. This results in that if the outer radius of cylinder 5$=r_1$, the inner radius of cylinder 6$=r_2$, the outer radius of cylinder 6$=r_3$, and the inner radius of cylinder 7$=r_4$, then the relationship between these radii shall substantially meet the following relation:

$$(r_4^2-r_3^2)=(r_2^2-r_1^2)$$

The blades in the inner blade ring 10 are turned in a right-hand helix, and the blades 13 in the outer blade ring 11 are turned in a left-hand helix. The blades 12 and 13 in both blade rings are conventionally streamlined and have their rounded portions facing towards the outside of the wall, i.e. away from the room to be ventilated. In this way there is obtained a greater efficiency in sucking out air from the room than for blowing in air, independent of the rotational direction of the impeller.

A regenerator 14 and 15, respectively, is arranged in the two channels 3 and 4, the regenerators being of a type such that they also distribute moisture. Regenerator material such as aluminum balls, cotton waste, chips or thin tubes may be used.

On both sides of the wall the ventilator is provided with a casing 16 having a first arcuate section 17 which has its bottom facing outwards and surrounds the inner channel 3 and connecting up on one side to a duct 18 leading air flowing from the inner channel 3 alohg the wall and has an opening 19 placed at a distance from the ventilator itself. In the figure the duct 18 is shown formed in one piece with the arcuate-shaped section 17 by the outwardly turned bottom being extended on one side. The duct 18 is provided with side walls such that air intake and air exhaust takes place at the opening 19. The casing 16 has a second section 20 which is annular and cup-shaped in cross section with the open end placed over the opening of the outer channel 4, and is provided with a second duct 21 extending along the wall in the opposite direction to the duct 18. This duct 21 is also illustrated in the figure as arranged in one piece with the section 20 so that the outwardly turned bottom of the section 20 is extended to one side and provided with side walls so that air inlet and air outlet take place at the opening 22. The casing 16 can be molded in plastics, for example.

A control circuit 23 is connected to the motor 8 such that the motor alternatingly rotates in either direction. Reversing can take place with a time circuit, but may also be arranged by sensing the temperature in the channels with the aid of a temperature probe 24 and 25, respectively, in the channels 3 and 4, respectively. The temperature probes 24 and 25 are suitably placed in the portion of the channels 3 and 4 facing towards the room to be ventilated. The differences in temperature sensed by the probes 24 and 25 can be decisive for determining the rotational direction of the motor 8. However, in cold weather it may be difficult to heat up the inflowing air with the outflowing air to a sufficient extent. The control means 23 may also therefore be connected to two heat coils 26 and 27, one coil 26 being placed in the duct 17 in the casing 16 placed on the inside of the wall 1, and the other coil 27 placed in the duct 27 in the same casing. When the temperature of the inflowing air in either of the channels 3 and 4 falls below a predetermined temperature, the control circuit 23 couples in the heat coil in the duct which is connected to this channel.

The ventilator according to FIG. 1 functions in the following manner. When the motor 8 rotates in the direction indicated by the arrow A, air is sucked into the room which is to be ventilated via the outer channel 4 and is sucked out from the room via the inner channel 3. When it is warmer in the room than outside and the warm indoors air passes throuoh the regenerator 14 in the channel 3, the air is cooled and therefore surrenders a portion of its moisture which is collected on the surface of the regenerator or is sucked into the regenerator if it is porous. After the motor is reversed so that it rotates in the direction indicated by the arrow B, air flows out through the same regenerator 14 and thereby takes up both heat and moisture from the regenerator on its way through it. The same function but in reversed phase position is obtained for the passage of air throuoh the channel 4 with the regenerator 15. This results in that the air indoors will not be substantially drier during the cold season than during the warm season.

The properties of the ventilator are particularly essential in wintertime, but even during summer they are advantageous, particularly if the room to be ventilated is at a lower temperature than the outdoors temperature, and it is desired to ventilate the room without it being heated up to any essential extent. The same property in respect to moisture in the air also applies in this case although with the reversed function, so that the hot outside air is dehumidified in its passage into the room and the cold indoors air takes up moisture on its way out.

FIG. 2 illustrates an embodiment of a control circuit for controlling reversing of the motor 8 with the aid of the difference in temperatures sensed by the temperature probes 24 and 25. The control circuit of FIG. 2 also illustrates a circuit with the aid of which the motor 8 is kept inactive during an adjusted time between each reversal such that the reversal will not take place too abruptly for the motor in order to avoid the risk of it being overheated.

One connection on each of the temperature probes 24 and 25, which are preferably thermistors, is connected to the plus pole on a voltage source VI. An operational amplifier 28 has a series connection of two resistors R2 and R1 across earth and their negative phase-inverted input, and a series circuit of two resistors R4 and R3 coupled across earth and its plus, non-phase inverted input. The other connection of the temperature probe 24 is coupled to the junction point between the resistance R1 and R2 and the other connection of the probe 25 is connected to the junction point between the resistors R3 and R4. A resistor R5 with adjustable resistance is coupled between the output of the operational amplifier 28 and the junction point between the resistors R3 and R4. The output of the amplifier 25 is connected to earth via a Schmitt trigger 29 and a relay coil L1. A switching contact K1 controlled by the relay coil L1 has its central contact connected via a further contact K2 to one pole of a voltage source V2, e.g. 220 volt AC. The motor 8 may be of the type 20 marketed by Heidolp-Elektro KG in West Germany. This motor is provided with two windings, and it rotates in either direction depending on which winding is supplied with current. One winding 30 on the motor is connected between the one fixed contact part A of the switching contact K1 and the other pole of the voltage source V2, while a winding 31 on the motor 8 is connected between the other fixed contact part B of the switching contact K1 and the other pole of the voltage source V2. A capacitor C is coupled between the two fixed contact parts A and B of the switching contact K1.

The resistances of the resistors R1 to R4 are selected such that for equilibrium the probes 24 and 25 give the same voltage on both inputs of the operational amplifier 28. The Schmitt trigger 29 is dimensioned to take both DC potentials, at which reversal of the trigger state takes place, on either side of the potential which the operational amplifier 28 has on its output for equilibrium and so that the reversal takes place for each state of the trigger output signal for equally as great temperature difference sensed by the probes 24 and 25, independent of whether the probe 24 or the probe 25 senses the lowest temperature. If the temperature in channel 3 is higher than the temperature in channel 1, the potential on the output of the Schmitt trigger 29 is high and the relay coil L1 is conducting. The contact K1 is then set in the position A and the voltage V2 is across the winding 30 of the motor 8. If the temperature in channel 3 then falls and the temperature in channel 4 rises, the resistance of the probe 24 increases so that the non-phase inverted input of the amplifier 28 is given a lower voltage. For a suitable adjustment of the resistance of the resistor R5 there is obtained a reversal of the Schmitt trigger at a temperature difference of 2°, for example, between the temperatures sensed by the probes 24 and 25. At the reversal, the voltage across the relay coil L1 declines to the region of 0 V and the relay is released, the contact K1 then being set to the position B, so that the voltage V2 is across the winding 31 and the motor 8 reverses.

In order to protect the motor 8 during reversal, it is suitable to interrupt the voltage to it completely for a few seconds at each reversal. It can also be an advantage to enable regulation of the air exchange of the ventilator, and this can be done by regulating the length of time that the voltage to the motor 8 is interrupted. A circuit providing this interruption is also illustrated in FIG. 2. The output of the Schmitt trigger 29 is connected to a delaying circuit 32, the lag time of which is adjustable by a variable resistor R6. The output of the Schmitt trigger 29 and the output of the delaying circuit 32 are each connected to an input on an exclusive OR gate 33. A relay coil L2 is coupled between the output of the gate 33 and earth. The relay coil L2 controls the condition of breaker contact K2 coupled between the contact K1 and the voltage source V2.

The circuit for interrupting voltage supply to the motor 8 functions as follows. The inputs to the exclusive OR gate 33 normally have the same condition which is either a high or a low potential. The output of the gate 33 then has a low potential, the relay coil 12 being inactivated and the contact K2 being closed. For a reversal of the Schmitt trigger 29 the upper input of the gate 33 is given the changed potential of the Schmitt trigger output directly whereas the lower input retains the potential of the Schmitt trigger output before the reversal during the time lag of the delaying circuit 32. The inputs of the gate 33 consequently have different potentials during this time the potential of the gate 33 on the output being high, which activates the relay coil L2 so that the contact K2 is broken and is kept broken during the time lag of the circuit 32.

It should be noted that the type of motor 8 and the control circuit for it in FIG. 2 is only to be regarded as an example of suitable units which may be used in the inventive ventilator. For example, instead of the type of motor used here, a DC motor or a commutator motor can be used. A semiconductor-controlled commutation should be utilized for obtaining long life, however. There are thus obtained larger possibilities of controlling the flow of the air, since the speed of the DC motor is easy to control.

As illustrated in FIG. 1, the fan is placed on the part of the ventilator facing towards the outside of the wall 1. This placing it suitable, since it gives a relatively low sound level in the room to be ventilated. For protecting the ventilator against dust and dirt, air filters can be arranged in the inlets and outlets of the ventilator both inside and outside (not shown).

The directional baffles 21 and 18 for the two air streams are suitably placed such that they direct the air streams horizontally along the wall. The casing illustrated in FIG. 1 is however to be regarded solely as a suitable embodiment, and other types of casing where the inlet air and outlet air are taken from different places are conceivable, e.g. where air supply or air exhaust in conjunction with the channel 3 takes place directly without a casing over this part and where an annular casing with outwardly folded flanges is connected to the channel 4 for guiding the air stream to or from this channel along the wall a distance out from the ventilator.

The heat coils 26 and 27 are suitably switchable in and out parallel to its respective motor winding 30 and 31 in FIG. 2 (not shown), which results in that only the heat coil which is placed in an air stream inducted into the ventilated room is activated.

What I claim is:

1. Ventilator adapted to be located in a wall for providing air exchange through the wall, said ventilator including:

(a) a double-acting, controllable, axial-flow fan means having an impeller with an inner blade ring and an outer impeller blade ring, the blades in said two rings being set to transport air in mutually different directions through said blade rings during rotation of said impeller;

(b) a coaxial duct having an inner channel in communication with said inner blade ring of said impeller, and an outer channel in communication with said outer impeller blade ring of said impeller;

(c) reversing means, connected to said fan means, for controlling said fan means to reverse the direction of said impeller so that said impeller alternately rotates in one or the other direction; and (d) regenerating means, located in both said inner channel and said outer channel for alternately absorbing and emitting heat, and absorbing and desorbing moisture;

(e) said ducts and said blade rings being mutually dimensioned such that the air flow provided in one of said ducts in one direction when the impeller is rotating in a first direction is essentially the same as the air flow provided in the other of said ducts in the same direction when said impeller is rotating in the opposite direction.

2. Ventilator as claimed in claim 1, characterized in that one impeller blade ring of said impeller has the blades arranged in a right-hand helix and the impeller blades of said other impeller blade ring arranged in a left-hand helix, and in that the blades in said two rings have streamlined blade profiles including rounded portions, said rounded portions of the blades in both rings facing in the same direction.

3. Ventilator as claimed in claim 1, characterized in that a means for separating from each other the openings for supply and exhaust of air to the two channels is placed at least on one side of the wall.

4. Ventilator as claimed in claim 3, characterized in that an air stream separating means including a first cupformed section which is placed over the inner channel and has a first duct extending along the wall, and also including a second section which is annular and extends over the outer channel and is separated from the inner section and has a second duct extending along the wall in the opposite direction to the first duct is placed at least on one side of said wall.

5. Ventilator as claimed in claim 1, characterized in that a temperature probe is placed in each of said two channels, and in that said probes are connected to said reversing means so as to control reversing of said impeller in accordance with the difference in temperature in said two channels sensed by said probes.

6. Ventilator as claimed in claim 1, characterized in that a heating coil is connected close to the inlet or outlet for air to each of said two channels on the side of the wall facing towards a room which is to be ventilated.

7. Ventilator as claimed in claim 1, characterized in that said reversing means includes a circuit for providing, at each reversal, interruption of the voltage supply to the fan motor for a predetermined time period.

8. Ventilator as claimed in claim 1 wherein the cross-sectional areas of said two ducts are substantially the same.

9. Ventilator as claimed in claim 2 wherein said rounded portions face towards the outside of the wall.

10. Ventilator as claimed in claim 7 further comprising means for varying said predetermined time period.

* * * * *